United States Patent [19]

Schaeffer et al.

[11] Patent Number: 4,863,527

[45] Date of Patent: Sep. 5, 1989

[54] PROCESS FOR PRODUCING DOPED TUNGSTEN WIRE WITH LOW STRENGTH AND HIGH DUCTILITY

[75] Inventors: Gene T. Schaeffer, Towanda; Thomas J. Patrician, Monroeton; Paul L. Bloss, Towanda, all of Pa.

[73] Assignee: GTE Products Corporation, Stanford, Conn.

[21] Appl. No.: 58,432

[22] Filed: Jun. 5, 1987

[51] Int. Cl.[4] ..... C22F 1/18

[52] U.S. Cl. ..... 148/11.5 F

[58] Field of Search ..... 148/11.5 F, 423, 133; 445/48; 72/286

[56] References Cited

U.S. PATENT DOCUMENTS 1,436,717 11/1922 Goucher ..... 148/11.5 F
1,461,140 7/1923 Ramage ..... 148/133
3,278,281 10/1966 Ehringer ..... 428/611

FOREIGN PATENT DOCUMENTS 48-00736 1/1973 Japan ..... 148/133
0075566 4/1985 Japan ..... 148/11.5 F

*Primary Examiner*—Wayland Stallard
*Attorney, Agent, or Firm*—Donald R. Castle; L. Rita Quatrini

[57] ABSTRACT

A process is disclosed for producing doped tungsten wire having a combination of relatively low strength and high ductility. The process involves swaging recrystallized rod to a diameter of from about 80 to about 125 mil, drawing this rod into wire having a diameter of from about 52 to about 62 mil, and stress-relief annealing the wire to impart the combination of low strength and high ductility to the wire when it is drawn to about 35 to about 37 mils.

7 Claims, 1 Drawing Sheet

PROCESS FOR PRODUCING DOPED TUNGSTEN WIRE WITH LOW STRENGTH AND HIGH DUCTILITY

This invention relates to a process for producing doped tungsten wire having a combination of relatively low strength and high ductility by a combination of swaging, drawing, and annealing steps.

BACKGROUND OF THE INVENTION

At present, tungsten wire doped with potassium, silicon, and aluminum and used as filaments in lamps is made by various processes giving wire with different combinations of strength and ductility. For example, 36 mil diameter wire (A) having a strength of about 48 g/mg/200 mm and elongation of about 1.5% on the average can be produced. Also, 36 mil diameter wire (B) having a strength of about 54 grams/mg/200mm and elongation of about 4% can be produced.

Wire having a combination of the strength in the range of that of A and the elongation in the range of that of B is not ordinarily produced. Wire having this combination of strength and ductility would be desirable for certain filament wire applications and for certain drawing operations to further reduce the size of the wire.

SUMMARY OF THE INVENTION

In accordance with one aspect of this invention, there is provided a process for producing doped tungsten wire having a combination of relatively low strength and high ductility. The process involves swaging recrystallized rod to a diameter of from about 80 to about 125 mil, drawing this rod into wire having a diameter of from about 52 to about 62 mil, and stress-relief annealing the wire to impart the combination of low strength and high ductility to the wire when it is drawn to about 35 to about 37 mils.

DETAILED DESCRIPTION OF THE INVENTION

For a better understanding of the present invention, together with other and further objects, advantages and capabilities thereof, reference is made to the following disclosure and appended claims in connection with the above described Figures and description of some of the aspects of the invention.

The starting tungsten rod of this invention is made of doped tungsten, that is tungsten doped with potassium, silicon, and aluminum. Doped tungsten material that is especially suited to the process of this invention is that which consists essentially of from about 99.95 to about 99.99% by weight tungsten.

The desired room temperature tensile strength of the wire of the present invention is from about 47 to about 50 strength units, that is g/mg/200mm or from about 257,000 to about 273,000 psi. The desired elongation is at least about 4%. This particular combination of strength and elongation is desirable in certain filament wire applications and for certain drawing operations to further reduce the size of the wire.

The rod has been typically recrystallized at a diameter of about 250 mil to about 280 mil. It is preferred that the rod be recrystallized at about 250 to about 260 mil, and most preferably at about 255 mil.

Figure 1:
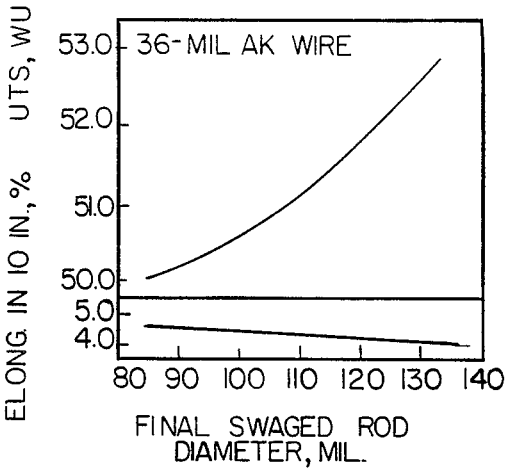
FIG. 1 is a plot of the swaged rod diameter versus the strength and elongation measured on 36 mil wire for various final swaged diameters both within this invention and outside this invention. The rod diameter at which swaging started is 273 mil and the rod is in a recrystallized state.

The rod is swaged to a diameter of about 80 mil to about 125 mil, and preferably to from about 118 mil to about 125 mil and most preferably to about 120 mil. Standard swaging temperatures and speeds are used in the swaging operation. Prior to this invention, the rod was swaged to about 136 mil and then drawn to about 36 mil where the strength and elongation values are measured. FIG. 1 is a plot of the room temperature tensile strength and elongation of 36 mil wire versus the final diameter of the swaged rod from which the wire was drawn. The rod diameter at which swaging started is 273 mil and the rod is in a recrystallized state. It can be seen that for swaged diameters down to about 85 mil, the strength is still at the high end of the desired range.

To affect further change in the tensile properties, primarily to further decrease the strength, a stress-relief anneal is combined with swaging to a smaller rod diameter. This is done by drawing the rod to a diameter of about 52 to about 62 mil and most preferably to about 60 mil, followed by stress relief annealing.

In accordance with a preferred embodiment, to avoid possible contamination from graphite lubricants on the surface during annealing, the above described wire is dip-cleaned in a hot sodium hydroxide-sodium nitrite solution before annealing.

The stress relief annealing is done to produce the strength and elongation characteristics which are desired in the wire at a size of about 35 to about 37 mil and most typically to about 36 mil. One preferred method of stress relief annealing, although the invention is not limited to such, it to anneal in an electric muffle furnace, passing through at a rate of typically about 12.5 ft/min. The furnace temperature is typically from about 1560° C. to about 1620° C. and preferably at about 1590° C. The atmosphere in the furnace is hydrogen gas.

Figure 2:
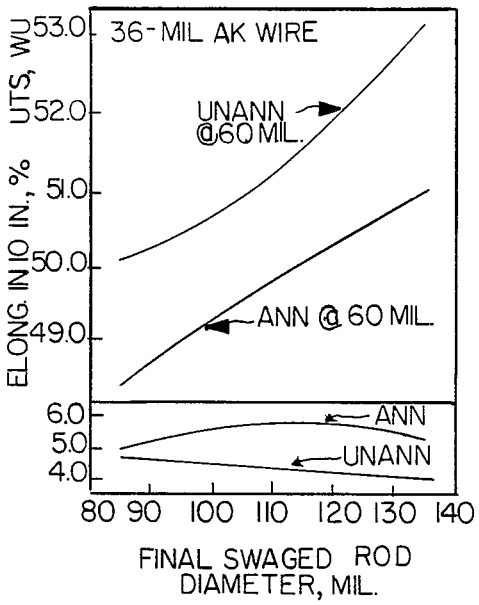
FIG. 2 is a plot of room temperature tensile strength and elongation versus the final swaging diameter for 36 mil wire with and without a 60 mil wire stress relief anneal. The rod diameter at which swaging started is 273 mil and the rod is in a recrystallized state.

FIG. 2 is a plot of room temperature tensile strength and elongation values vesus the final swaging diameter for 36 mil wire with and without a 60-mil stress relief anneal. The Figure shows that a 36 mil wire with the optimum desired properties, that is, strength of about 48 g/mg/200 mm and a percentage elongation of about 5% is obtained by swaging the rod to about 85 mil and by stress-relief annealing at about 60 mil.

The 35 to 37 mil wire can be further reduced in size if desired. The strength and elongation (ductility) characteristics of the wire allow the reductions to take place satisfactorily.

Figure 3:
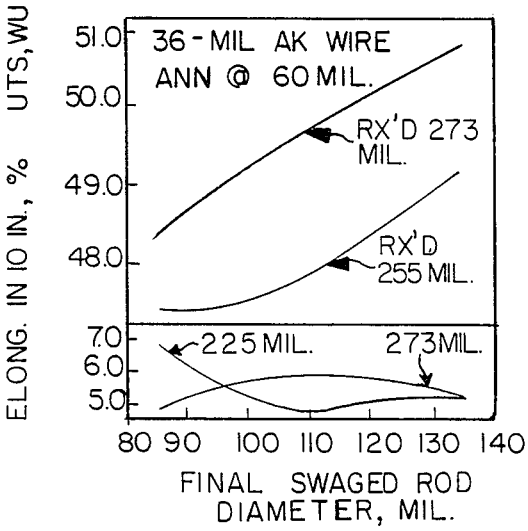
FIG. 3 is a plot of the room temperature tensile strength and elongation of 36 mil wire versus the final diameter of the swaged rod for wire that was given a stress relief anneal at 60 mil and came from rod that was recrystallized at either 273 mil or 255 mil. The rod diameter at which swaging started is 273 mil.

In accordance with a preferred embodiment, the starting rod can be swaged to about 118 mil to about 122 mil. This is more convenient than to smaller size, for example around 85 mil. This is most readily done if the starting rod is recrystallized at a diameter of about 250 to about 250 mil and most preferably about 255 mil. Lowering the recrystallization point in combination with swaging to a smaller rod diameter, but not necessarily to as low as about 85 mil, and a stress-relief anneal from about 52 to about 62 mil results in the desired tensile properties measured on 36 mil wire drawn from the respective wire. FIG. 3 shows room temperature tensile properties of 36 mil wire processed in this way. FIG. 3 is a plot of the room temperature tensile strength and elongation of 36 mil wire versus the final diameter of the swaged rod for wire that was given a stress relief anneal at 60 mil and came from rod that was recrystallized at either 273 mil or 255 mil. The rod diameter at which swaging started is 273 mil. The 36 mil wire drawn from rod swaged only to about 120 mil has a strength of about 48 units and an elongation of about 5%, which is within the desired combination range for this invention. Swaging the 255 mil rod to sizes below about 120 mil further reduces the strength of the 36 mil wire with no adverse effects on the ductility. Standard recrystallization conditions are used for the 255 mil rod.

It can be seen that the process of the present invention results in the desired combination of strength and ductility properties which are useful for certain applications such as wire for filaments of high wattage incandescent lamps or for stranded wire.

While there has been shown and described what are at present considered the preferred embodiments of the invention, it will be obvious to those skilled in the art that various changes and modifications may be made therein without departing from the scope of the invention as defined by the appended claims.

What is claimed is:

1. A process for producing doped tungsten wire having a combination of relatively low tensile strength and high ductility, said process comprising:

(a) swaging a recrystallized rod made of tungsten doped with potassium, silicon, and aluminum to a diameter of from about 80 mil to about 125 mil;

(b) drawing the swaged rod into wire having a diameter of from about 52 mil to about 62 mil; and (c) stress relief annealing said wire to impart said combination of relatively low tensile strength and high ductility to said wire after it is subsequently drawn to from about 35 mil to about 37 mil.

2. A process of claim 1 wherein said doped tungsten consists essentially of from about 99.95% to about 99.99% by weight tungsten.

3. A process of claim 1 wherein said recrystallized rod has been recrystallized at a diameter of from about 250 mil to about 280 mil.

4. A process of claim 3 wherein said recrystallized rod has been recrystallized at a diameter of from about 250 mil to about 260 mil.

5. A process of claim 4 wherein said recrystallized rod is swaged to from about 118 mil to about 122 mil.

6. A process of claim 1 wherein said annealing is done at a furnace temperature of from about 1560° C. to about 1620° C.

7. A process of claim 1 wherein the tensile strength of said 35 mil to 37 mil diameter wire is from about 47 to about 50 g/mg/200 mm and wherein said wire has an elongation of at least about 4%.

* * * * *